US007210419B2

(12) United States Patent
Naka et al.

(10) Patent No.: US 7,210,419 B2
(45) Date of Patent: May 1, 2007

(54) SEWING MACHINE CAPABLE OF EMBROIDERY SEWING AND DISPLAY CONTROL PROGRAM THEREFOR

(75) Inventors: Takafumi Naka, Aichi-ken (JP); Takashi Hirata, Nagoya (JP); Ayako Yoshimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/196,711

(22) Filed: Aug. 4, 2005

(65) Prior Publication Data

US 2006/0027154 A1 Feb. 9, 2006

(30) Foreign Application Priority Data

Aug. 6, 2004 (JP) ..... 2004-230197

(51) Int. Cl.
*D05B 21/00* (2006.01)

(52) U.S. Cl. ..... 112/470.06; 700/136; 700/138

(58) Field of Classification Search ..... 112/102.5, 112/470.06, 470.09, 475.19; 700/130, 131, 700/132, 135, 136, 137, 138
See application file for complete search history.

(56) References Cited

U.S. PATENT DOCUMENTS 5,865,133 A * 2/1999 Herbach et al. ..... 112/475.19
5,943,972 A * 8/1999 Hirata ..... 112/102.5
5,960,727 A * 10/1999 Miyasako et al. ..... 112/102.5
6,004,018 A * 12/1999 Kawasato et al. ..... 700/138
6,237,516 B1 * 5/2001 Wakayama ..... 112/102.5
6,256,551 B1 * 7/2001 Muto ..... 700/138
6,600,966 B1 * 7/2003 Bailie ..... 700/138

FOREIGN PATENT DOCUMENTS

JP 2000-024350 A 1/2000

* cited by examiner

*Primary Examiner*—Gary L. Welch
*Assistant Examiner*—Nathan Durham
(74) *Attorney, Agent, or Firm*—Oliff & Berridge, PLC

(57) ABSTRACT

A sewing machine includes an embroidery stitching data storage storing embroidery stitching data of a plurality of divided patterns with respect to large-size embroidery patterns, a pattern display data storage storing pattern display data for displaying each large-size embroidery pattern in a real image close to an embroidered state, and a display control device reading pattern display data with respect to an appointed large-size embroidery pattern from the pattern display data storage and controls to display an image. The display control device is adapted so that, when each divided pattern constituting the large-size embroidery pattern is subjected to the embroidery stitching, a display is caused to display the pattern display data of the large-size embroidery pattern read from the pattern display data storage and displayed area data indicating the stitching area occupied by each divided pattern in the large-size embroidery pattern in a state being combined with each other.

8 Claims, 18 Drawing Sheets

18b

| | |
|---|---|
| LARGE-SIZE EMBROIDERY PATTERN NUMBER | 1 |
| NAME OF LARGE-SIZE EMBROIDERY PATTERN | BOUQUET 1 |
| LARGE-SIZE EMBROIDERY PATTERN DISPLAY DATA | BIT MAP DATA |
| DISPLAY SIZE OF LARGE-SIZE EMBROIDERY PATTERN | X2, Y2 |
| NUMBER OF DIVIDED PATTERNS | 4 |
| DISPLAY SIZE OF DIVIDED PATTERN 1 | X0, Y1; X0, Y2; X1, Y2; X1, Y1 |
| DISPLAY SIZE OF DIVIDED PATTERN 2 | X1, Y1; X1, Y2; X2, Y2; X2, Y1 |
| DISPLAY SIZE OF DIVIDED PATTERN 3 | X0, Y0; X0, Y1; X1, Y1; X1, Y0 |
| DISPLAY SIZE OF DIVIDED PATTERN 4 | X1, Y0; X1, Y1; X2, Y1; X2, Y0 |
| ILLUSTRATION DISPLAY DATA OF DIVIDED PATTERN 1 | BIT MAP DATA |
| ILLUSTRATION DISPLAY DATA OF DIVIDED PATTERN 2 | BIT MAP DATA |
| ILLUSTRATION DISPLAY DATA OF DIVIDED PATTERN 3 | BIT MAP DATA |
| ILLUSTRATION DISPLAY DATA OF DIVIDED PATTERN 4 | BIT MAP DATA |
| STITCHING ORDER OF DIVIDED PATTERNS | FIRST ·· DIVIDED PATTERN 1 |
| | SECOND ·· DIVIDED PATTERN 2 |
| | THIRD ·· DIVIDED PATTERN 3 |
| | FOURTH ·· DIVIDED PATTERN 4 |

FIG.3

SEWING MACHINE CAPABLE OF EMBROIDERY SEWING AND DISPLAY CONTROL PROGRAM THEREFOR

CROSS-REFERENCE TO RELATED APPLICATIONS

This application is based upon and claims the benefit of priority from the prior Japanese Patent Application No. 2004-230197, filed on Aug. 6, 2004 the entire contents of which are incorporated herein by reference.

BACKGROUND

The present invention relates to a sewing machine capable of embroidery stitching, which is provided with a embroidery frame driving mechanism for driving a embroidery frame based on embroidery stitching data, and a display; and with respect to a large-size embroidery pattern larger than an embroidery area of the embroidery frame, capable of dividing into a plurality of divided patterns and performing embroidery stitching thereon, and a display control program for controlling the display on the display screen.

Conventionally, sewing machines capable of embroidery stitching, which perform embroidery-stitching operations while shifting a embroidery frame holding a cloth to be stitched freely in horizontal directions, have been put into practical use. In another type of sewing machine, a controller reads out embroidery stitching data with respect to a desired embroidery pattern selected by a user from a plurality of embroidery patterns and controls a embroidery frame driving mechanism, which drives the embroidery frame based on the embroidery stitching data; thus, the embroidery stitching operation is carried out. In this case, it is arranged so that a plurality of embroidery stitching data are previously stored in an internal storage such as nonvolatile memory provided to the controller, or read out from an external storage such as ROM card or flexible disk.

Recently, for sewing machines of this type, users are requesting to stitch larger embroidery patterns. To respond to such requests, a sewing machine capable of stitching large size embroidery patterns larger than the embroidery area of the embroidery frame has been considered. For example, in an embroidery data-creating means disclosed in Japanese Published Unexamined Patent Application No. 2000-24350, it has been disclosed to divide a large-size embroidery pattern into a plurality of partial patterns. And the embroidery data with respect to the respective divided patterns, which can be handled in one stitching operation, are created. Owing to this, even with a large size embroidery pattern, embroidery stitching can be made in several divided stitching operations.

In such sewing machines capable of embroidery stitching, an LCD display or the like is provided thereto. When a user selects an embroidery pattern and carries out the embroidery stitching operation, an image (configuration) of the embroidery pattern is displayed on the display. Owing to this, the user can check the embroidery pattern on the display.

When displaying an image (configuration) of an embroidery pattern on the display, generally, the display data with respect to each embroidery pattern is previously stored in a memory, and from the memory, necessary display data is read out and displayed on the display screen. Also, as a technique different from the above, another sewing machine, in which, display data is not stored in the memory, but based on the embroidery stitching data (data of needle location), a display data creating process is carried out to develop display data, and the pattern display data created in the display data creating process is displayed on the display, has been put into practical use.

However, in the former case where the display data is previously stored, to save the memory capacity or the like, the data amount of the display data per embroidery pattern is limited to a small amount. Therefore, only a rough configuration of the embroidery pattern is displayed in a relatively small size on the display. In the case of a relatively small embroidery pattern, even when the displayed image is rough, the user feels little inconvenience. However, in the case of the above-described large-size embroidery pattern, there reside the following disadvantages. That is, the user hardly recognizes the detailed configuration of the embroidery pattern using such a rough display; or, the image viewed on the display is different from the actually stitched embroidery pattern.

On the other hand, in the later case where the display data is created based on the embroidery stitching data through a display data creating process, a detailed image close to an embroidered state of the embroidery pattern can be displayed. However, particularly, in the case of a large-size embroidery pattern, there may be included such a precise embroidery pattern of which the number of stitching exceeds, for example, 100 to 200 thousand stitches. The size of the data amount to be handled is too large, and a significant amount of computing time is required for the display data creating process resulting in such a disadvantage that the embroidery pattern cannot be displayed swiftly on the display.

SUMMARY

Therefore, an object of the present invention is to provide a sewing machine, which is capable of embroidery stitching of a large-size embroidery pattern, and when displaying an embroidery pattern on the display, a detailed image can be displayed swiftly, and a display control program.

The present invention provides a sewing machine capable of embroidery stitching provided with an embroidery frame driving mechanism for driving an embroidery frame based on embroidery stitching data, and in the case of a large-size embroidery pattern larger than an embroidery area of the embroidery frame, capable of dividing the pattern into a plurality of divided patterns and to perform the embroidery stitching, comprising an embroidery stitching data storage unit that stores embroidery stitching data of the plurality of divided patterns with respect to a plurality of large-size embroidery patterns, a display adapted so as to display the embroidery patterns, a pattern display data storage unit that stores a plurality of pattern display data for displaying each of the plurality of large-size embroidery patterns on the display in a real image close to an embroidered state, and a display control device that reads out pattern display data with respect to an appointed large-size embroidery patterns from the pattern display data storage unit and controls to display an image on the display, the display control device being adapted so that, when each of the plurality of divided patterns constituting the large-size embroidery pattern is subjected to the embroidery stitching, the display control device causes the display to display the pattern display data of the large-size embroidery pattern read out from the pattern display data storage unit and displayed area data indicating the stitching area occupied by each of the divided patterns in the large-size embroidery pattern in a state being combined with each other.

The display control device is adapted so as to read out pattern display data with respect to an appointed large-size embroidery pattern from the pattern display data storage unit, and causes the display to display the large-size embroidery pattern in a real image close to an embroidered state. Accordingly, in the case of a large-size embroidery pattern, the user can observe the display to know the detailed configuration of the large-size embroidery pattern. Here, different from such a manner that the pattern display data is created from the embroidery stitching data and displayed, since the pattern display data can be read out from the pattern display data storage unit and displayed, the pattern can be displayed swiftly.

Further, the present invention also provides a rough display data storage unit that stores rough display data for displaying the large-size embroidery pattern in a rough image on the display, and a detailed display data computing unit that computes the detailed display data for causing the display to display a divided pattern in a real image close to an embroidered state based on the embroidery stitching data of the divided pattern stored in the embroidery stitching data storage unit. And the present invention is adapted so that the display control device combines rough display data stored in the rough display data storage unit and detailed display data of a divided pattern computed by the detailed display data computing unit and causes the display to display a partially detailed large-size embroidery pattern.

By the display control device, a partially detailed large-size embroidery pattern is displayed on the display. In the partially detailed large-size embroidery pattern, a divided pattern in the large-size embroidery pattern is displayed in a real image close to an embroidered state, and the remaining part thereof is displayed in a rough image. Accordingly, the user can know a rough configuration of the whole large-size embroidery pattern, and as to a selected divided pattern therein, know the detailed configuration of the finished stitch. Here, the detailed display data computing unit computes, not the whole large-size embroidery pattern, but detailed display data with respect to the divided pattern. Accordingly, the period of time required for creating processing of display data can be reduced resulting in a swift display, and the data amount to be handled can also be reduced.

BRIEF DESCRIPTION OF THE DRAWINGS

Other objects, features and advantages of the present invention will become clear upon reviewing the following description of the embodiment with reference to the accompanying drawings, in which:

FIG. 3 shows pattern data of a large-size embroidery pattern;

DETAILED DESCRIPTION OF THE INVENTION

Figure 1:
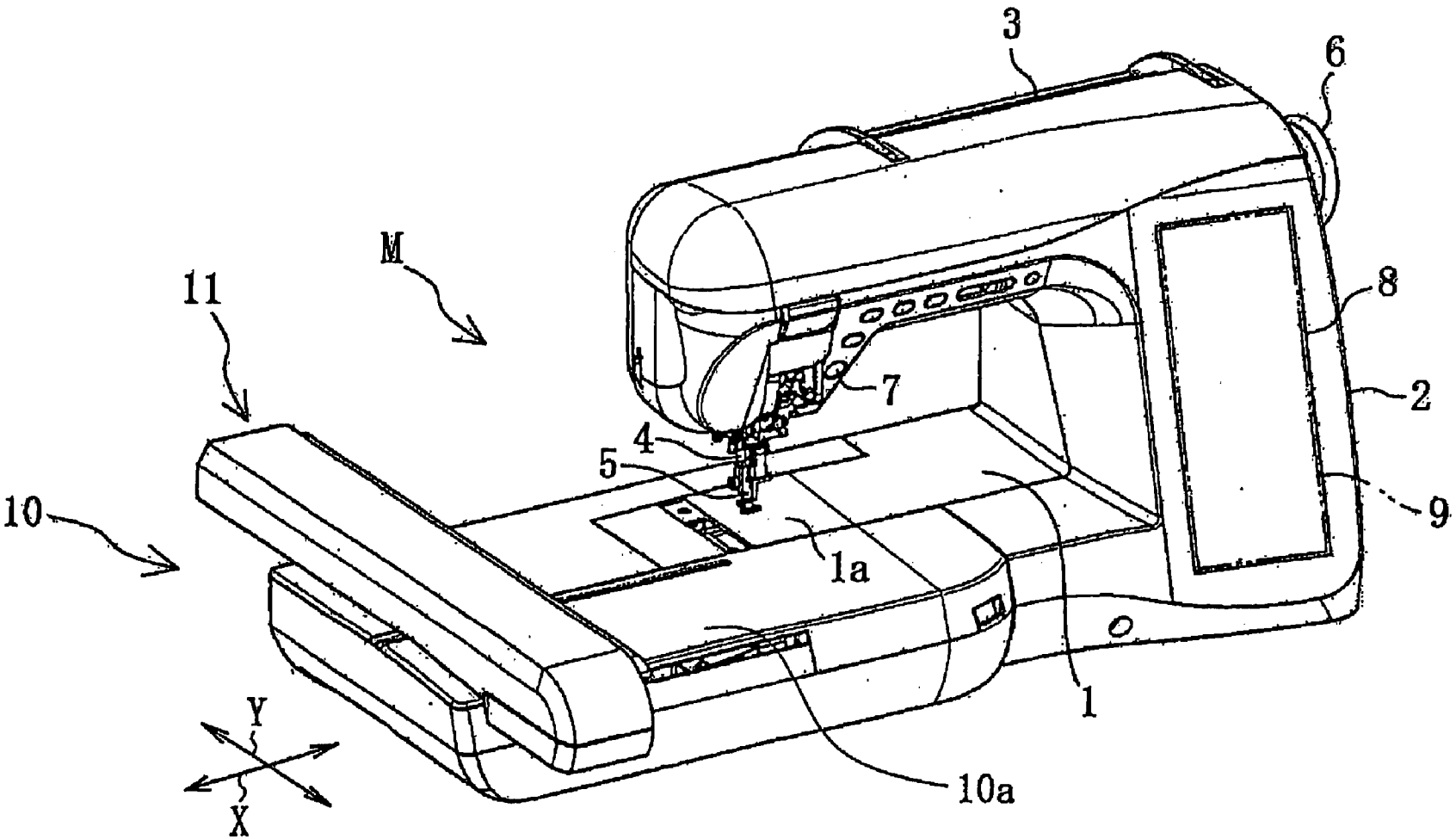
FIG. 1 is a perspective view of an electronic sewing machine capable of embroidery stitching as an embodiment of the present invention.

Hereinafter, an embodiment of the present invention will be described below with reference to FIGS. 1 to 16.

First, the entire structure of an electronic sewing machine M capable of embroidery stitching will be simply described with reference to FIG. 1. The main body of the electronic sewing machine M is integrally structured of a bed section 1, a supporting column 2 upstanding from the right end portion of the bed section 1, and an arm section 3 extending leftward in FIG. 1 from the upper end of the supporting column 2.

In the front-lower end portion of the arm section 3, a needle bar 4 having a sewing needle 5 is provided. In the upper face of the bed section 1, a needle plate 1*a* is provided corresponding to the needle bar 4. Within the bed section 1, under the needle plate 1*a*, not shown is a feed dog up/down driving mechanism for driving a feed dog vertically and a feed dog forward/backward driving mechanism for driving the feed dog forward and backward, a rotary hook, which receives a bobbin and cooperates with the sewing needle 5 to form seams, and thread cutter mechanism or the like.

Within the arm section 3, a spindle of the sewing machine (not shown), which is driven to spin by a sewing machine motor 30 (refer to FIG. 2), is provided in the horizontal direction. Also, to the right side surface of the arm section 3, a hand pulley 6 is provided for manually rotating the spindle of the sewing machine. Within the arm section 3, not shown is a needle bar driving mechanism for vertically driving the needle bar 4, a needle bar swinging mechanism for causing the needle bar 4 to swing in the direction perpendicular to the cloth feeding direction (right-left direction), a needle thread take-up driving mechanism for driving a needle thread take-up to move vertically synchronously with the vertical movement of the needle bar 4 and the like. In the front face side of the arm section 3, various kinds of switches such as an ON/OFF switch 7 for giving instructions to start/stop the stitching work.

Here, the feed dog up/down driving mechanism, the needle bar vertical movement mechanism and the like are driven being in conjunction with the spindle of the machine, which is driven to spin by the machine motor 30. Further, it is arranged so that the needle bar swinging mechanism is driven by a stepping motor 31 for swinging the needle bar (refer to FIG. 2), and the feed dog forward/backward driving mechanism is driven by a stepping motor 32 for driving the feed dog forward/backward (refer to FIG. 2). Owing to this, a stitching mechanism for carrying out the stitching operation on a cloth to be stitched is structured. In a utility stitch mode, utility stitching such as straight line stitching and zigzag stitching are carried out in combination with the cloth feeding operation and needle swinging operation via the stitching mechanism.

Figure 16:
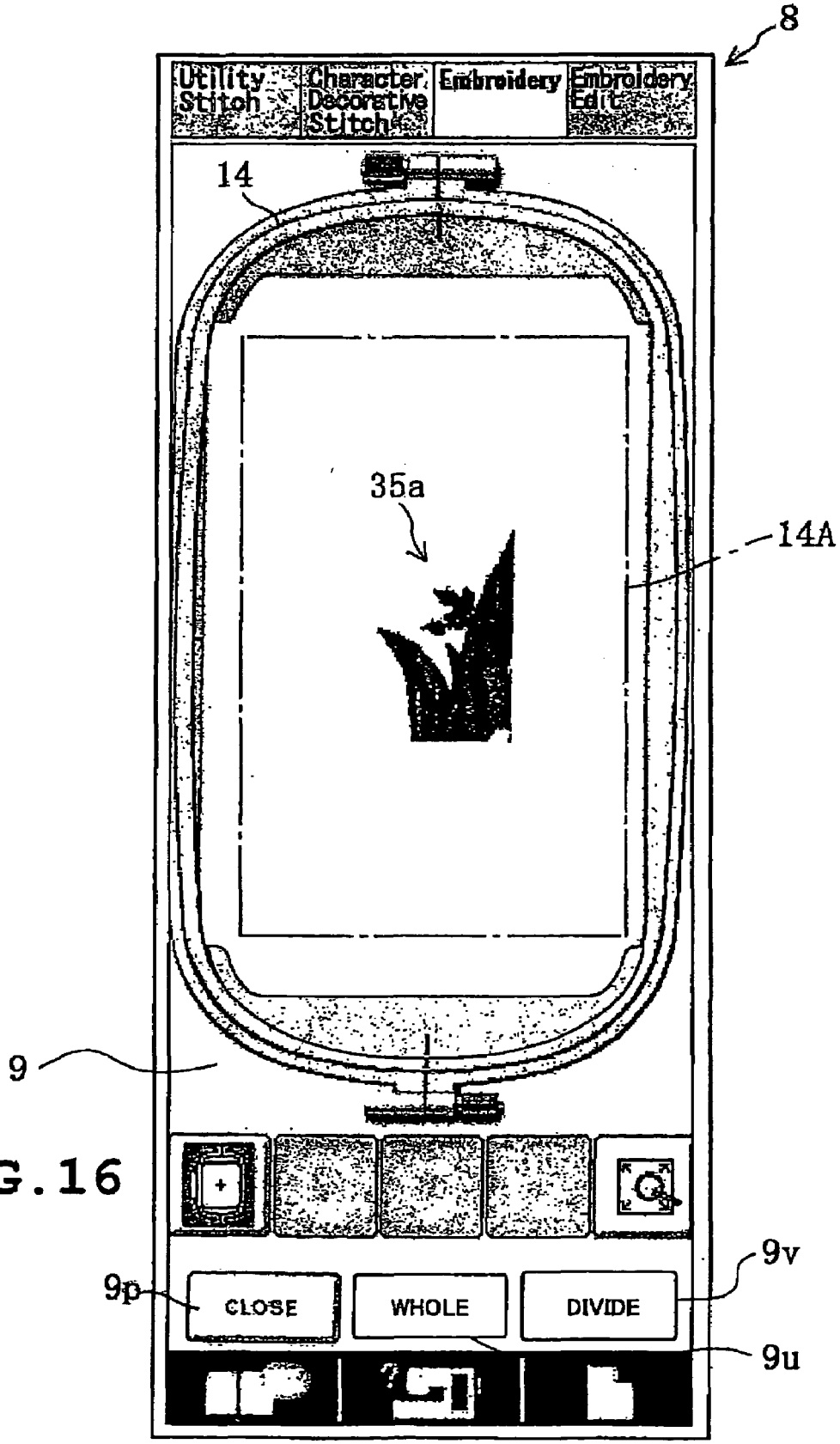
FIG. 16 shows a display example of a display screen of a divided pattern including a embroidery frame.

In the left-side portion of the bed section 1, it is arranged so that a well-known embroidery frame driving mechanism 10 is detachably mounted. The embroidery frame driving mechanism 10 moves the embroidery frame holding a cloth to be stitched (omitted in FIG. 1) in the X-direction and Y-direction freely on the bed section 1. In this embodiment, as shown in FIG. 1, the direction in which the bed section 1 extends, i.e., the right-left direction is defined as the X-direction; and the cross direction perpendicular thereto is defined as the Y-direction. FIG. 16 shows a embroidery frame 14 displayed as an image on a display 8, which will be described later. The embroidery frame has an embroidery area 14A of a rectangular shape slightly longer than is wide.

The embroidery frame driving mechanism 10 is provided with a body case 10*a*, which is the same in height as that of the upper face (bed surface) of the bed section 1 in the mounted state, and a Y-direction driving section 11, which is provided movably in the X-direction on the upper face portion of the body case 10. To the Y-direction driving section 11, the embroidery frame is detachably attached, and a carriage for shifting the embroidery frame to the Y-direction is provided (detailed figure thereof is omitted).

Within the body case 10*a*, an X-feed motor 12 (refer to FIG. 2) and an X-direction driving mechanism (not shown) for driving the Y-direction driving section 11 in the X-direction is provided. Within the Y-direction driving section 11, a Y-feed motor 13 (refer to FIG. 2) and a Y-direction driving mechanism for driving the carriage in the Y-direction is provided.

Figure 2:
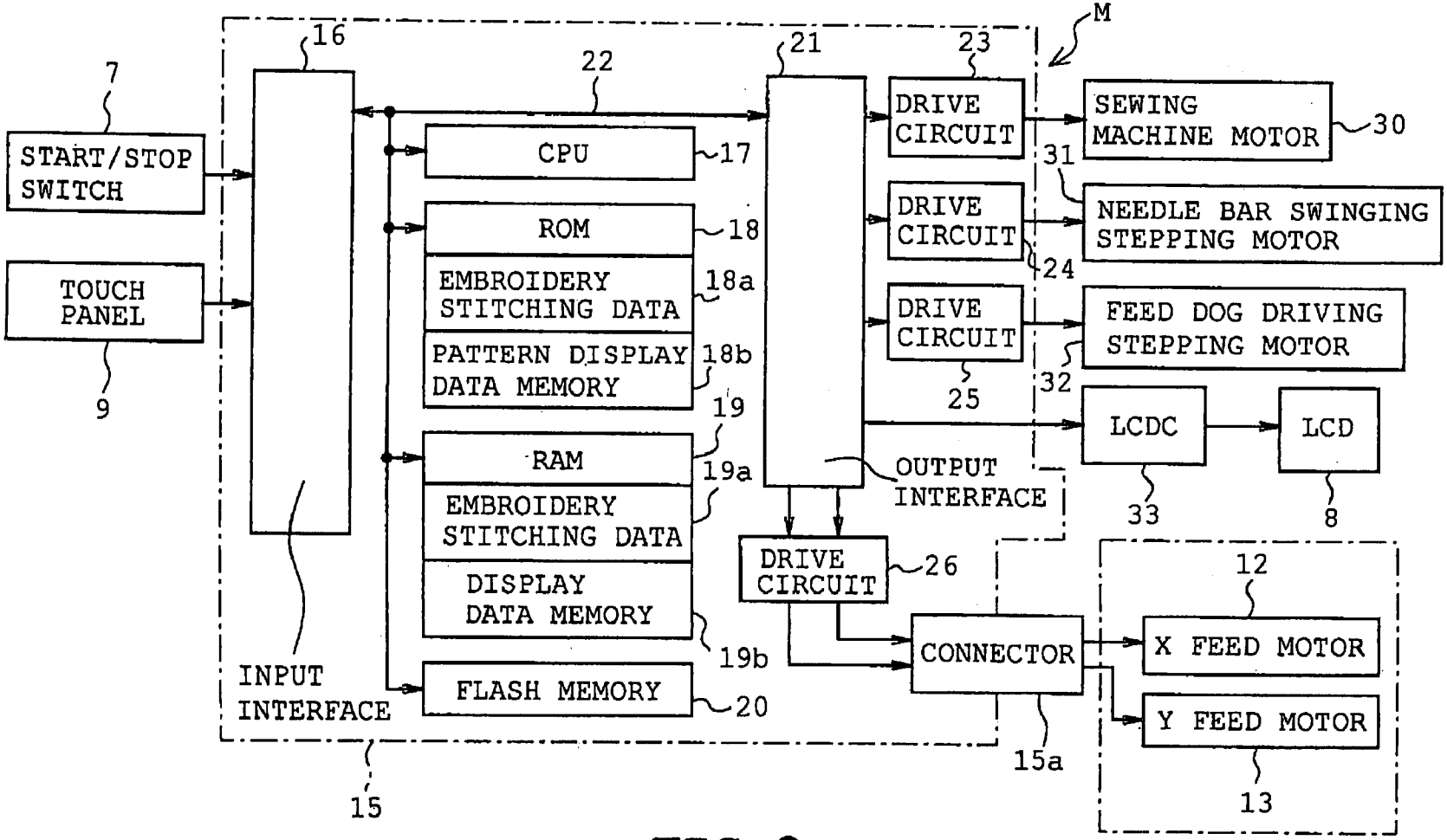
FIG. 2 is a block diagram showing a configuration of a control system of the electronic sewing machine.

In the state mounted on the bed section 1, as shown in FIG. 2, the embroidery frame driving mechanism 10 is electrically connected to a controller 15 of the electronic sewing machine M via connector 15*a*. Here, in place of the utility stitching mode, an embroidery stitching mode is set up, and the controller 15 controls the machine motor 30, the X-feed motor 12, the Y-feed motor 13 and the like based on the embroidery stitching data and the like. Owing to this, the embroidery frame is driven to shift in the X-direction and the Y-direction; thus, the embroidery stitching operation is carried out automatically on the cloth to be stitched held by the embroidery frame.

As shown in FIG. 1, on the front face of the supporting column 2, a large liquid crystal display (LCD) 8 (hereinafter, simply referred to as display 8) having a shape longer than is wide, which is capable of displaying images in full color, is provided. The display 8 is adapted so as to display various stitching patterns such as utility patterns, embroidery patterns and the like, function names for carrying out various functions necessary for stitching work, and further various messages and the like.

On the surface of the display 8, a well-known touch panel 9 formed of a transparent electrode is provided. Owing to this, as shown in FIGS. 10 to 16, the touch panel 9 is adapted so as to set up various touch keys (9*a*, 9*b*, 9*c*, . . . ). By carrying out touch operation on the touch keys (9*a*, 9*b*, 9*c*, . . . ) with his/her finger, a user can input instructions such as selection of desired embroidery pattern, selection of function, numerical value setting and the like, which are used for stitching.

Next, the control system of the electronic sewing machine M will be described below with reference to FIG. 2. As shown in FIG. 2, the electronic sewing machine M is provided with a controller 15, which mainly comprises a microcomputer for controlling the entirety. The controller 15 includes an input interface 16, a CPU 17, a ROM 18, a RAM 19, a nonvolatile flash memory 20, which allows electrical rewriting, and an output interface 21, which are connected to each other via a bus 22. Further, drive circuits 23 to 26 are connected to the output interface 21.

Connected to the input interface 16 are the ON/OFF switch 7 and the touch panel 9. Connected to the output interface 21 are drive circuits 23 to 25 that drive the motors 30 to 32 respectively, a display controller (LCDC) 34 that controls the display on the screen of the display 8, and a drive circuit 26 that drives the X-feed motor 12 and the Y-feed motor 13.

In the ROM 18, a stitching control program for driving and controlling the stitching mechanism and embroidery frame driving mechanism 10 and the like to carry out the stitching operation (utility stitching, embroidery stitching) and a display control program for controlling the various displays on the display 8 and the like are previously stored. Also, the ROM 18 is provided with an embroidery stitching data 18*a* and a pattern display data memory 18*b*.

The embroidery stitching data 18*a* stores sewing data for carrying out the utility stitching and embroidery stitching data for carrying out the pattern stitching of the previously stored a plurality of embroidery patterns based on the pattern number. Here, among the embroidery patterns, large-size embroidery patterns, which are larger than the embroidery area 14A of the embroidery frame, are included. And the large-size embroidery patterns are divided into a plurality of divided patterns, and embroidery-stitching data for embroidery stitching are included. Accordingly, the embroidery stitching data 18*a* functions as embroidery stitching data storage unit.

In the pattern display data memory 18*b*, pattern display data for displaying plural kinds of embroidery patterns on the display 8 are stored on the pattern number basis. Here, as for the a plurality of large-size embroidery patterns, a plurality of pattern display data for displaying each of the large-size embroidery patterns in a real image close to an embroidered state are stored on the pattern number basis. Accordingly, the pattern display data memory 18*b* functions as the pattern display data storage unit.

In the RAM 19, embroidery stitching data 19*a* for storing the read out embroidery stitching data of a selected embroidery pattern, a display data memory 19*b* for storing the pattern display data read out from the pattern display data memory 18*b*, various memories for storing computing results computed by the CPU 17, a pointer, a counter and the like are provided as appropriate.

Now, the above-described large-size embroidery pattern and the pattern display data thereof will be described below while taking a large-size embroidery pattern 35 of a [bouquet 1] shown in FIG. 4 as a particular example. In the large-size embroidery pattern 35, the whole stitching area (a square area in which the large-size embroidery pattern 35 enclosed by parallel lines in the X-direction and the Y-direction) is, for example, in this case, substantially bisected in the vertical direction and the horizontal direction, and divided into four divided patterns. These four divided patterns are numbered as divided patterns 1 to 4 in the stitching order. In the screen of the display 8, an X-Y coordinate system, in which the zero point (0, 0) is set to the apex at the left-bottom in the whole stitching area in FIG. 4, is assumed.

Figure 4:
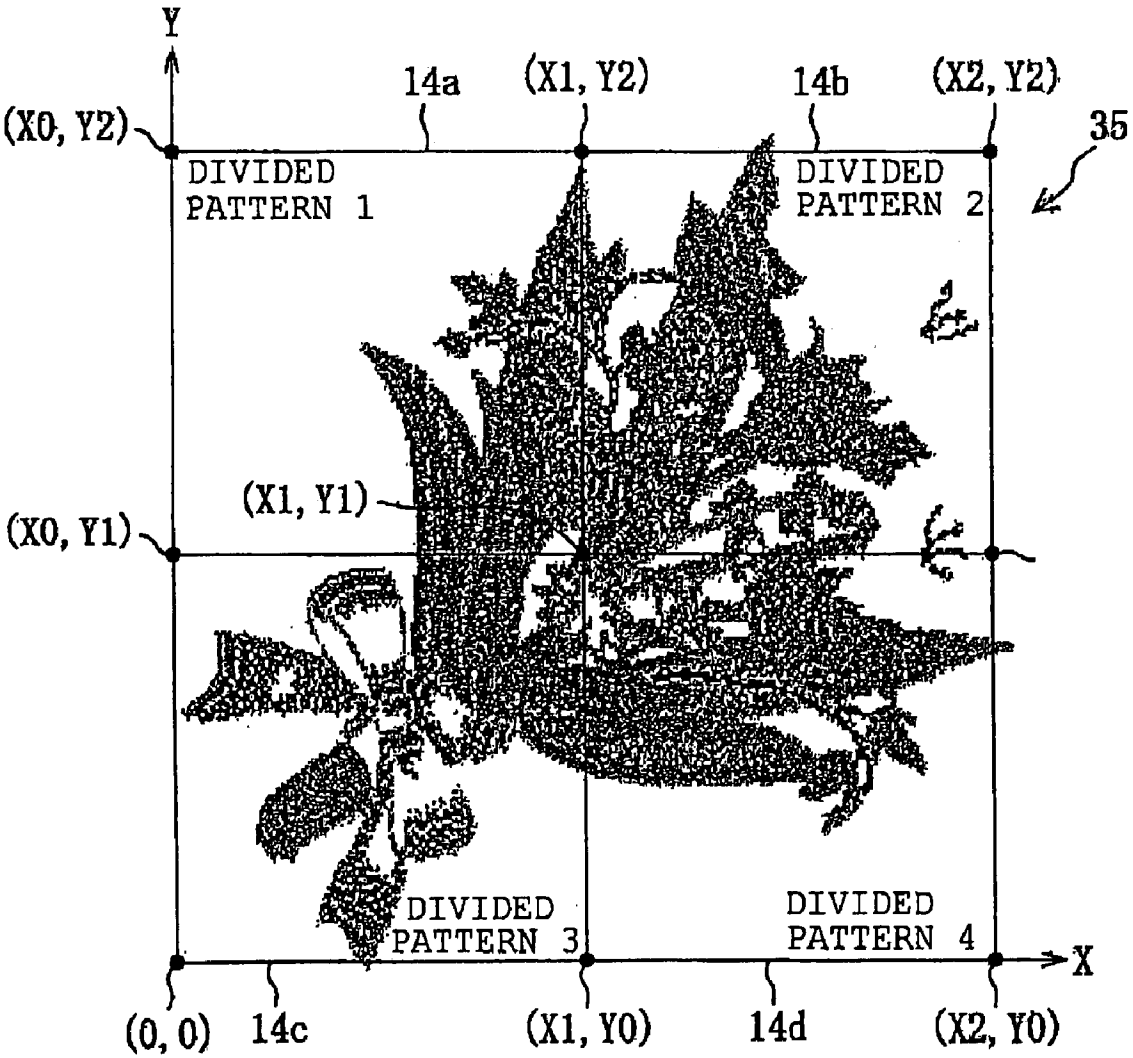
FIG. 4 shows a particular example of a relationship between the large-size embroidery pattern and divided patterns thereof.

The pattern display data of the large-size embroidery pattern 35 of the [bouquet 1] is comprised of monochrome bit map data of which the display size is X2 in the horizontal direction and Y2 in the vertical direction as shown in FIG. 4. The display size (embroidery area) 14*a* of the divided pattern 1 is set up in a rectangular area enclosed by 4 vertices of (X0, Y1), (X0, Y2), (X1, Y2) and (X1, Y1); the display size (embroidery area) 14*b* of the divided pattern 2 is set up in a rectangular area enclosed by 4 vertices of (X1, Y1), (X1, Y2), (X2, Y2) and (X2, Y1); the display size (embroidery area) 14*c* of the divided pattern 3 is set up in a rectangular area enclosed by 4 vertices of (X0, Y0), (X0, Y1), (X1, Y1) and (X1, Y0); and the display size (embroidery area) 14*d* of the divided pattern 4 is set up in a rectangular area enclosed by 4 vertices of (X1, Y0), (X1, Y1), (X2, Y1) and (X2, Y0).

FIG. 3 schematically shows the constitution of the pattern display data with respect to the large-size embroidery pattern 35 of the [bouquet 1]. The pattern display data includes the following data; i.e., large-size embroidery pattern number, name of the large-size embroidery pattern, large-size embroidery pattern display data (monochrome bitmap data) for displaying the large-size embroidery pattern in a real image close to an embroidered state, display size of the large-size embroidery pattern, number of divided-displayed patterns, display size in which each of the divided patterns (1, 2, 3, . . . ) constituting the large-size embroidery pattern is displayed, illustration display data for selecting a large-size embroidery pattern on the selection screen, illustration display data for displaying each of the divided patterns (1, 2, 3, . . . ) on the selection screen, stitching order of the divided patterns and the like.

The controller 15 reads out the embroidery stitching data with respect to the embroidery pattern selected by the user from the embroidery stitching data 18*a* and controls the stitching mechanism and the embroidery frame driving mechanism 10 based on the embroidery stitching data to carry out the embroidery stitching operation. When the large-size embroidery pattern 35 is selected, the embroidery pattern 35 is divided into a plurality of divided patterns and the embroidery stitching operation is carried out.

Also, the controller 15 executes the display control program to control the display on the display 8, which will be described later in detail with reference to a flow chart. Here, in the initial state of the embroidery-stitching mode, the controller 15 controls the display 8 to display a menu screen (refer to FIG. 10). When the user operates a one-point pattern key 9*a* on the menu screen, a pattern selection screen (refer to FIG. 11) is displayed.

It is arranged so that, when the user selects a desired embroidery pattern on the pattern selection screen, the pattern display data of the selected embroidery pattern is read out from the pattern display data memory 18*b* and displayed on the display 8. When a large-size embroidery pattern is selected, the pattern display data with respect to the large-size embroidery pattern is read out from the pattern display data memory 18*b* and the whole large-size embroidery pattern is displayed in a real image close to an embroidered state on the display 8 (refer to FIG. 12). Accordingly, the controller 15 functions as the display control unit.

Further, the controller 15 is adapted so as to display the whole large-size embroidery pattern and each of a plurality of divided patterns constituting the large-size embroidery pattern on the display 8 (refer to FIG. 13 etc.), and control to switch therebetween. The user can switch between the whole pattern display and the divided pattern display by operating a [WHOLE] key 9*u* or a [DIVIDE] key 9*v*. Once the actual embroidery stitching work has started, the display is automatically switched to a divided pattern presently under embroidery stitching.

In this embodiment, the controller 15 is adapted so as, when executing the whole display of the large-size embroidery pattern, to display a stitching area of the divided patterns being combined with each other (refer to FIG. 14); to display the divided patterns and the stitching area thereof being combined with each other (refer to FIG. 15); or to display the divided patterns and the embroidery area of the embroidery frame being combined with each other (refer to FIG. 16).

Figure 5:
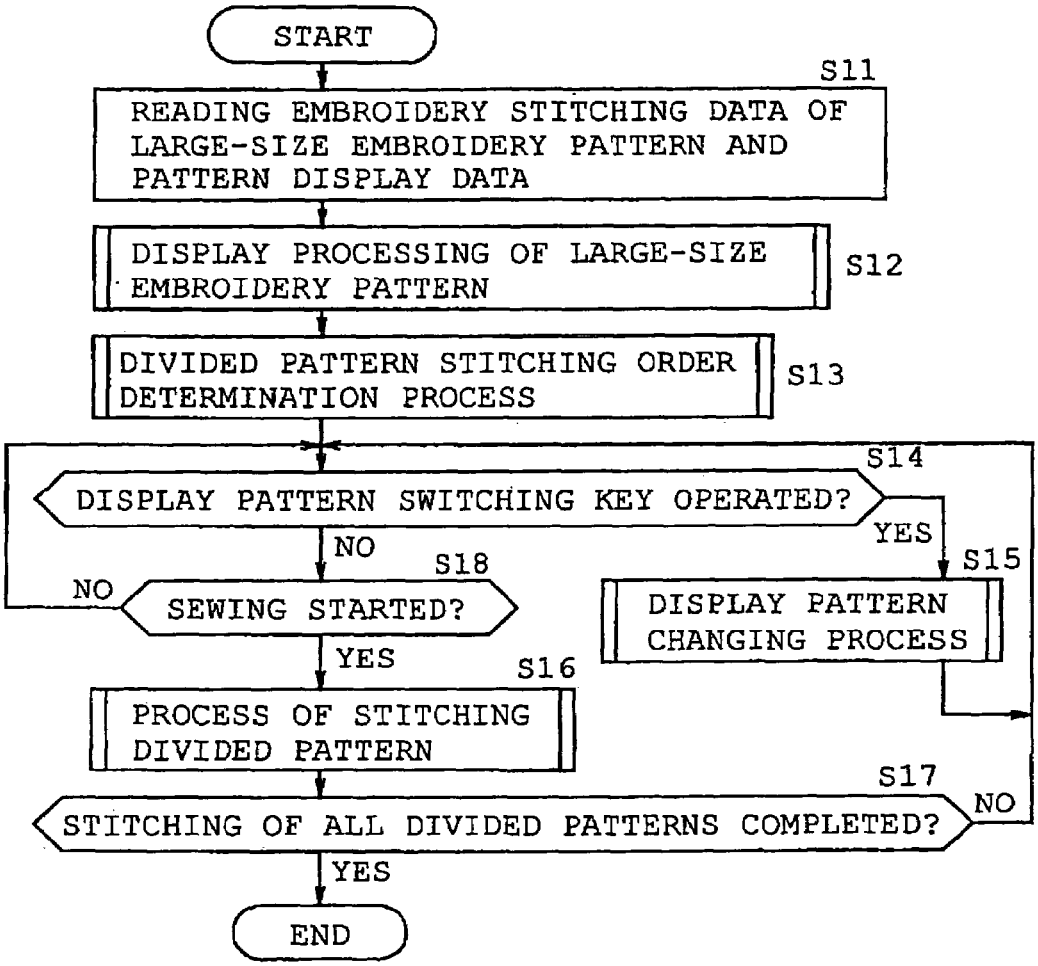
FIG. 5 is a flow chart showing processing steps in the stitching control of an embroidery pattern.

Next, the working of the electronic sewing machine M structured as described above will be described below with reference to the flow charts in FIGS. 5 to 9, and the examples of display in FIGS. 10 to 16. The flow chart in FIG. 5 shows the entire process of the embroidery pattern stitching control executed by the controller 15. Each of the flow charts in FIGS. 6 through 9 shows detailed steps in each process of steps S12, S13, S15 and S16 of the flow chart in FIG. 5. The reference numerals Si (i=11, 12, 13 . . . ) in the figures indicate the respective steps.

Figure 10:
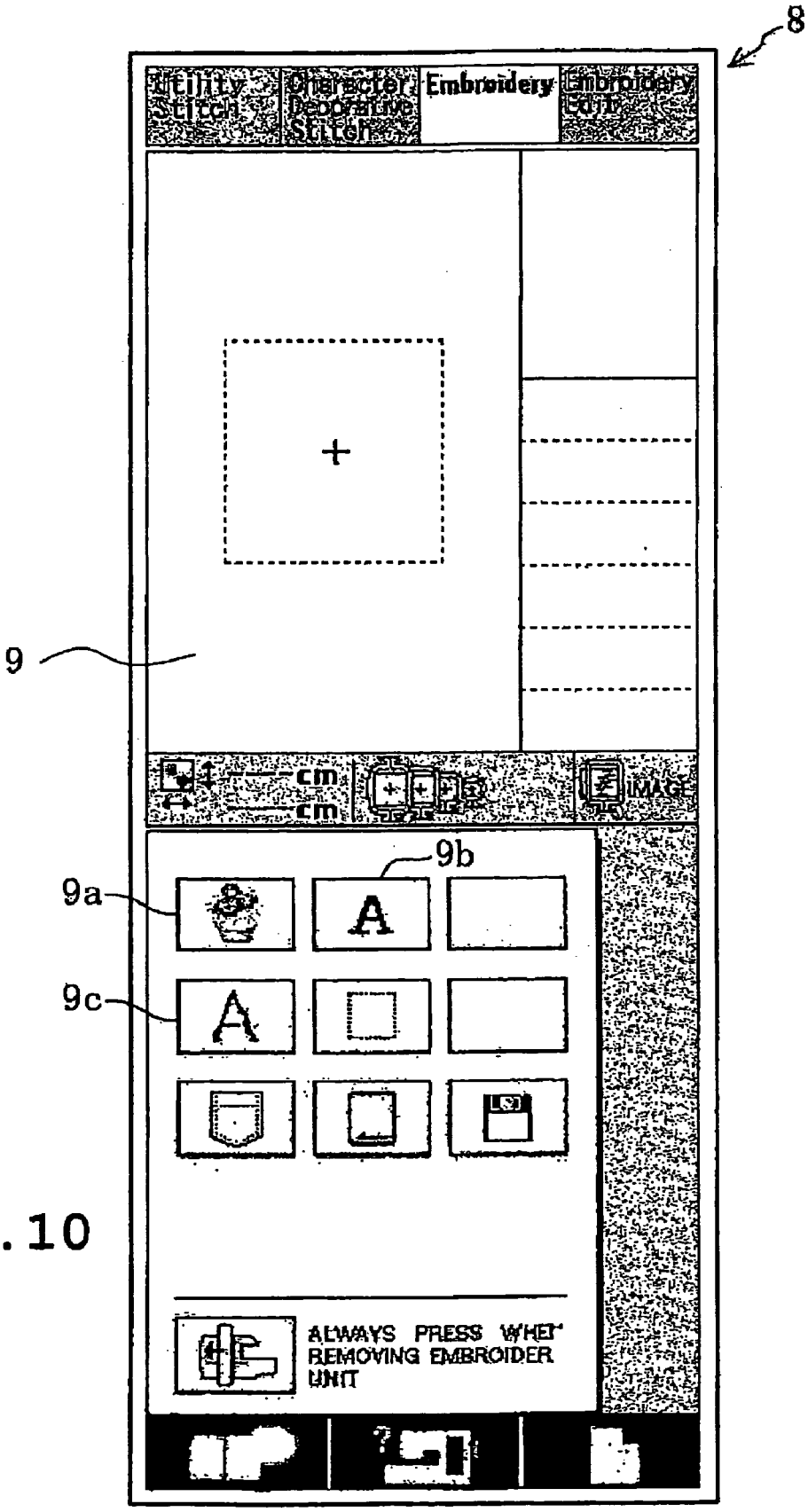
FIG. 10 shows an example of a menu screen.

To carry out the embroidery stitching operation of a desired embroidery pattern, the user (stitching operator) mounts the embroidery frame driving mechanism 10 to the bed section 1, and attaches the embroidery frame holding a cloth to be stitched to the embroidery frame driving mechanism 10. In this state, the [menu screen] shown in FIG. 10 is displayed on the screen of the display 8. On the [menu screen], a plurality of pattern selection keys 9*a*, 9*b*, 9*c*, . . . , another plurality of function keys and the like for individually selecting the embroidery patterns (design patterns and character patterns), which are previously stored therein, are displayed (set up).

Figure 11:
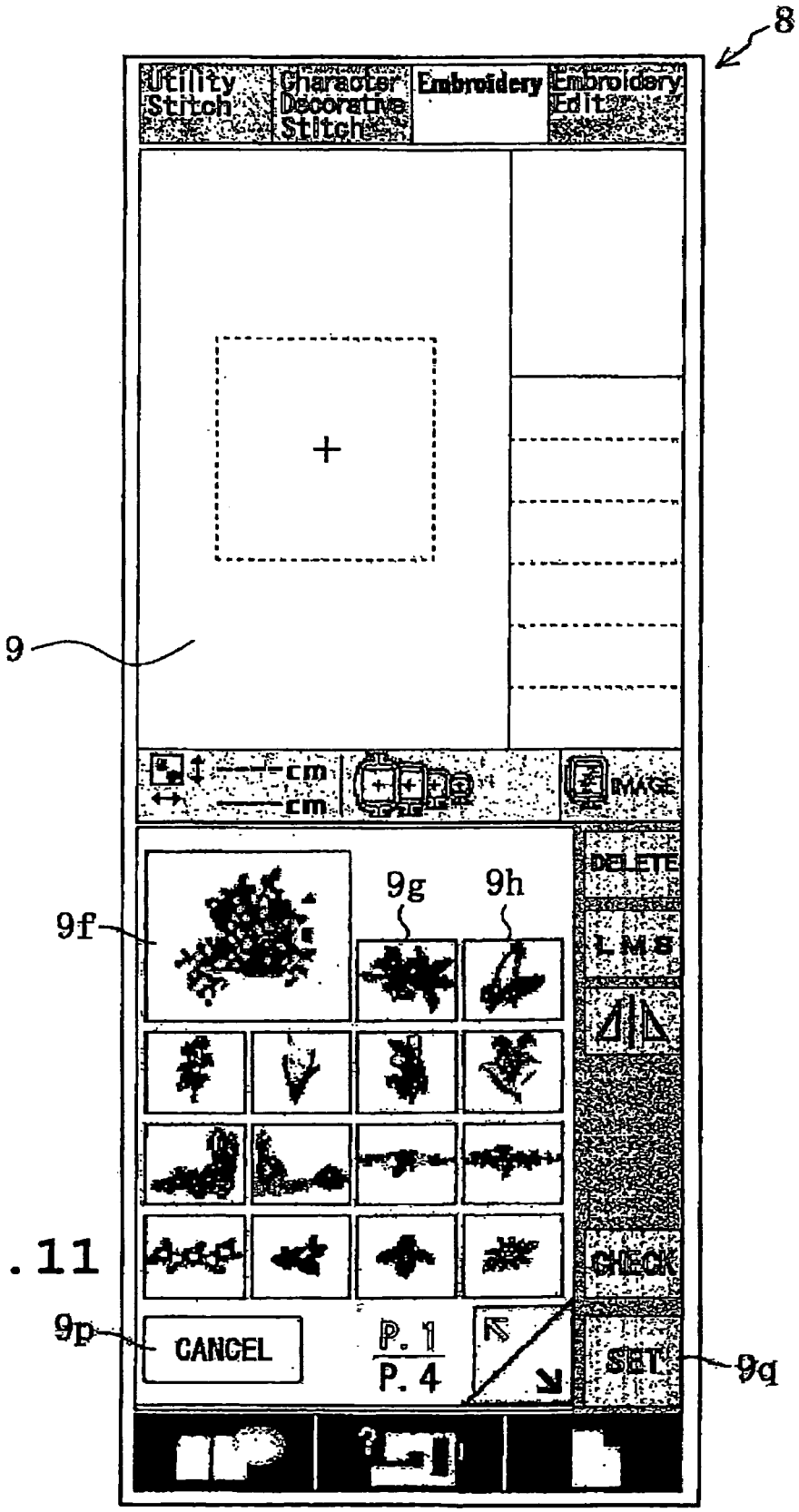
FIG. 11 shows an example of an embroidery pattern selection screen.

When the user turns ON the one-point pattern key 9*a* on the screen, the screen of the display 8 is switched to [pattern selection screen] shown in FIG. 11. On the [pattern selection screen], a plurality of pattern selection keys 9*f* to 9*h* and the like are displayed to allow the user to select a desired pattern. On each of the pattern selection keys 9*f* to 9*h*, the relevant embroidery patterns are displayed illustratively. In this case, the pattern selection key 9*f* is the large-size embroidery pattern key 9*f* for selecting a large-size embroidery pattern of the [bouquet 1]; and the others are the ordinary pattern select keys 9*g*, 9*h*, . . . for selecting ordinary embroidery patterns which are completed by one embroidery stitching respectively. Other a plurality of function keys 9*p*, 9*q*, . . . such as [CANCEL] and [SET] are displayed.

When the large-size embroidery pattern key 9*f* is operated and, for example, the large-size embroidery pattern 35 of the [bouquet 1] is selected on the [pattern selection screen], the control shown in the flow chart in FIG. 5 is started. That is, first of all, the embroidery stitching data of the selected large-size embroidery pattern 35 is read out from the embroidery stitching data 18*a* and written in the stitching data memory 19*a*; and the pattern display data of the large-size embroidery pattern 35 is read out from the pattern display data memory 18*b* and written in the display data memory 19*b* (S11). And then, the display processing of the large-size embroidery pattern is carried out (S12).

Figure 6:
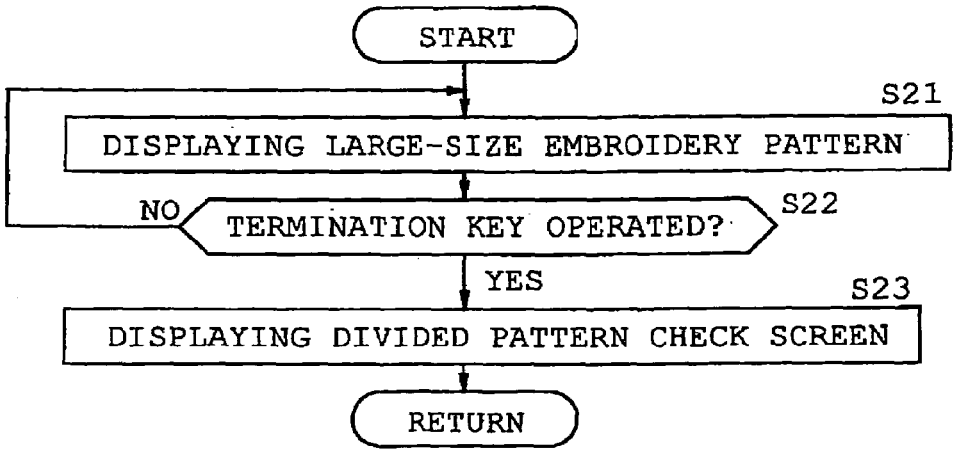
FIG. 6 is a flow chart showing processing steps in the display processing control of a large-size embroidery pattern.
Figure 12:
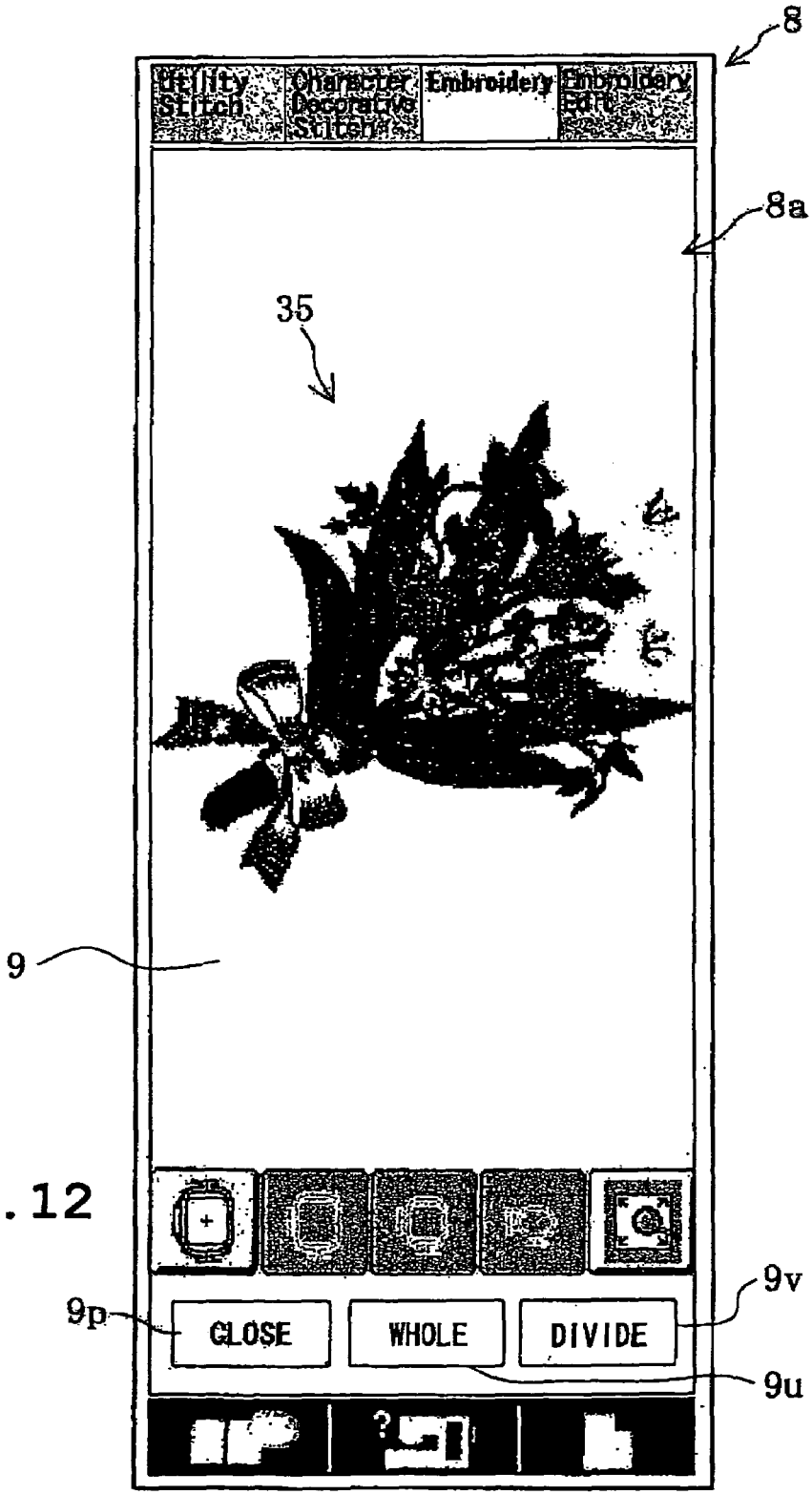
FIG. 12 shows a display example of a large-size embroidery pattern display screen.

The flow chart in FIG. 6 shows detailed steps of the display processing of the large-size embroidery pattern. That is, first, based on the pattern display data of the selected large-size embroidery pattern, the large-size embroidery pattern 35 is displayed in the pattern display area 8*a* on the display 8 (S21). FIG. 12 shows a state in which the large-size embroidery pattern 35 of the [bouquet 1] is displayed. In the pattern display area 8*a* of the display 8, based on the pattern display data of the large-size embroidery pattern 35, the large-size embroidery pattern 35 is displayed in a real image close to an embroidered state. Accordingly, a precise display of the large-size embroidery pattern 35 is realized.

Owing to such a real stitching pattern in a state of the finished embroidery the user can check the detailed large-size embroidery pattern 35 of the selected [bouquet 1] with his/her own eyes before beginning the embroidery stitching. When the termination key (close key) 9*p* is operated (S22: Yes), the divided pattern check screen is displayed (S23). Then, the process returns to the embroidery pattern stitching control (flow chart in FIG. 5).

Figure 13:
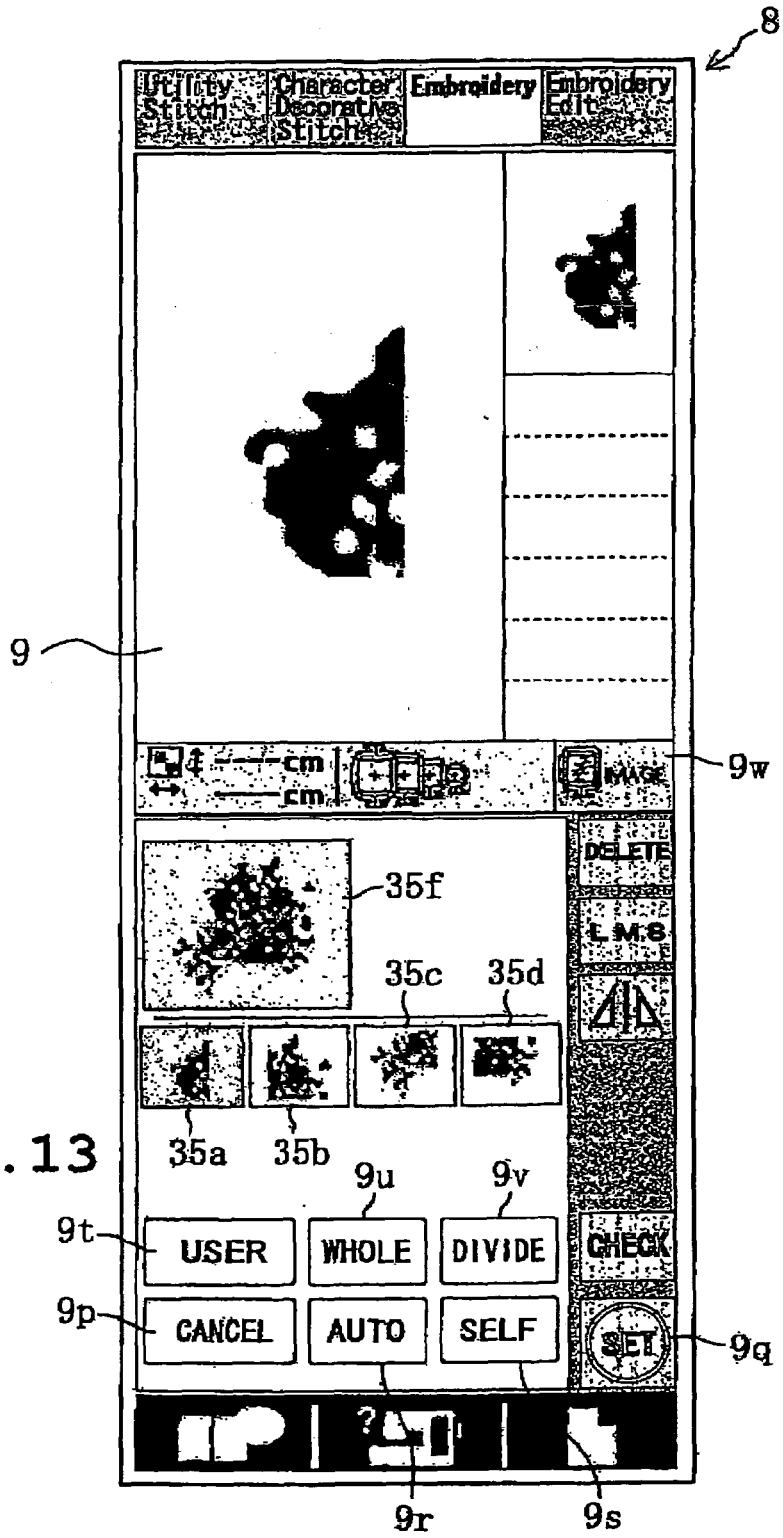
FIG. 13 shows a display example of a divided pattern stitching order check screen.

FIG. 13 shows an example of the divided pattern check screen. In the substantially lower half portion of the display 8, an illustrative embroidery pattern 35*f* of the large-size embroidery pattern 35 is displayed and four divided patterns 35*a* to 35*d* constituting the large-size embroidery pattern 35 are displayed in the order of stitching from the left. In this case, the stitching order (display order) is previously set up in the pattern display data (refer to FIG. 3).

In a state the divided pattern check screen is displayed on the display 8, the process returns to divided pattern stitching order determination process (S13) in FIG. 5.

Figure 7:
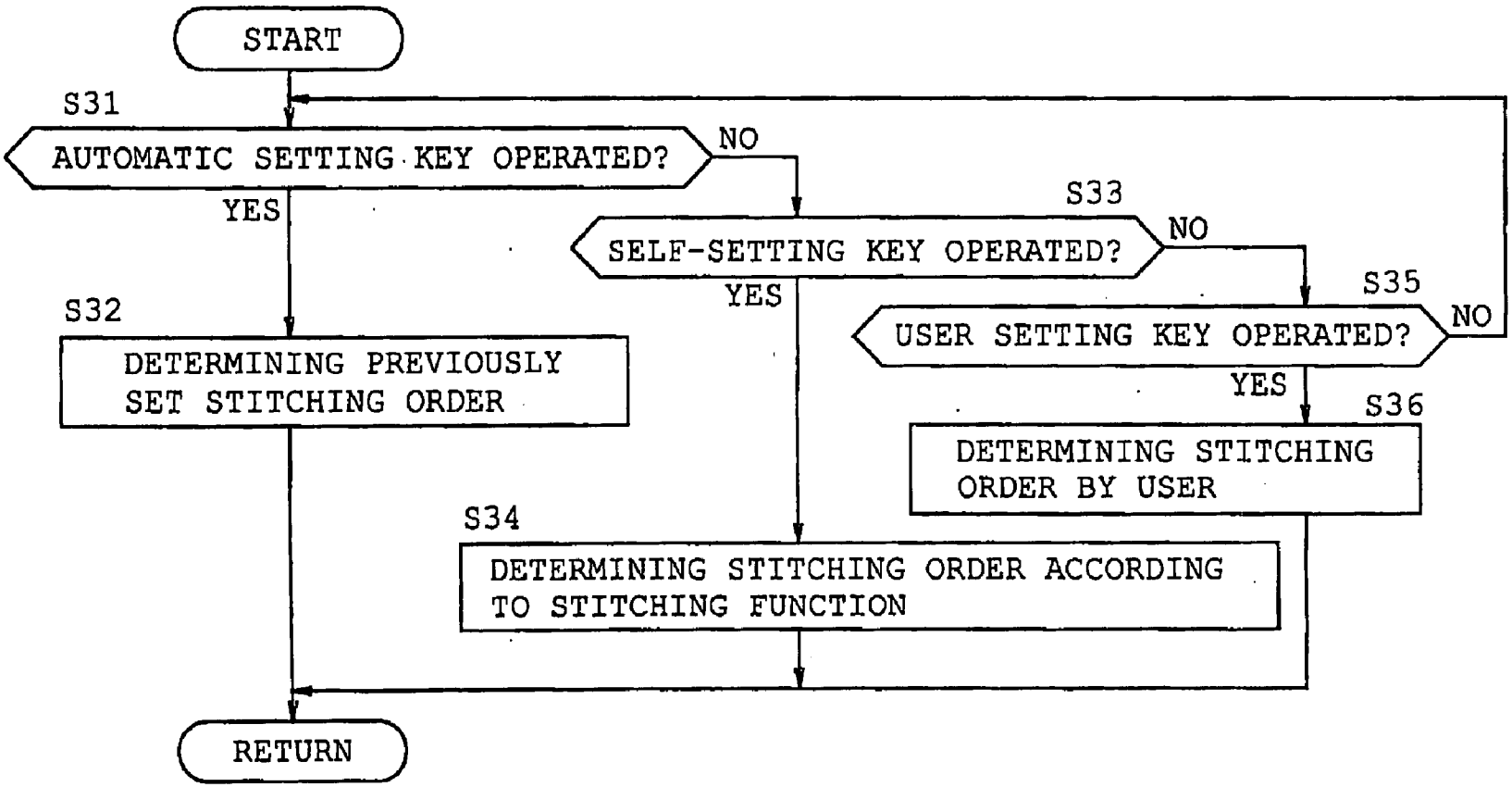
FIG. 7 is a flow chart showing processing steps in the divided pattern stitching order determination processing control.

The flow chart in FIG. 7 shows detailed steps of the divided pattern stitching order determination process. That is, in this process, waiting for a key operation by the user, when an automatic setting key (AUTO key) 9*r* is operated (S31: Yes), the resultant stitching order is determined as the previously set up stitching order (S32). When a self-setting key (SELF key) 9*s* is operated by the user (S32: Yes), the resultant stitching order is determined by the controller 15 depending on the stitching functions of the electronic sewing machine M while referring to the previously set up stitching order (S34).

Contrarily, when the user wants to set up the stitching order by him/herself while taking into consideration the shrinkage due to the sewing and the like, the user operates a user setting key (USER key) 9*t*. When the user setting key (USER key) 9*t* is operated (S35: Yes), the process is carried out where the user determines the stitching order (S36). The stitching operator determines the stitching order by pressing the divided patterns 35*a* to 35*d* in the stitching order. Thus, when the stitching order has been determined, this control is terminated, and the process returns to the embroidery pattern stitching control (flow chart in FIG. 5).

Referring to FIG. 5 again, after waiting for the key operation by the user, it is determined whether a display pattern switching key (IMAGE key) 9*w* is operated (S14), and further, it is determined whether the ON/OFF switch 7 is operated (S18). Here, when the display pattern switching key (IMAGE key) 9*w* is operated (S14: Yes), the display pattern changing process is carried out (S15).

Figure 8:
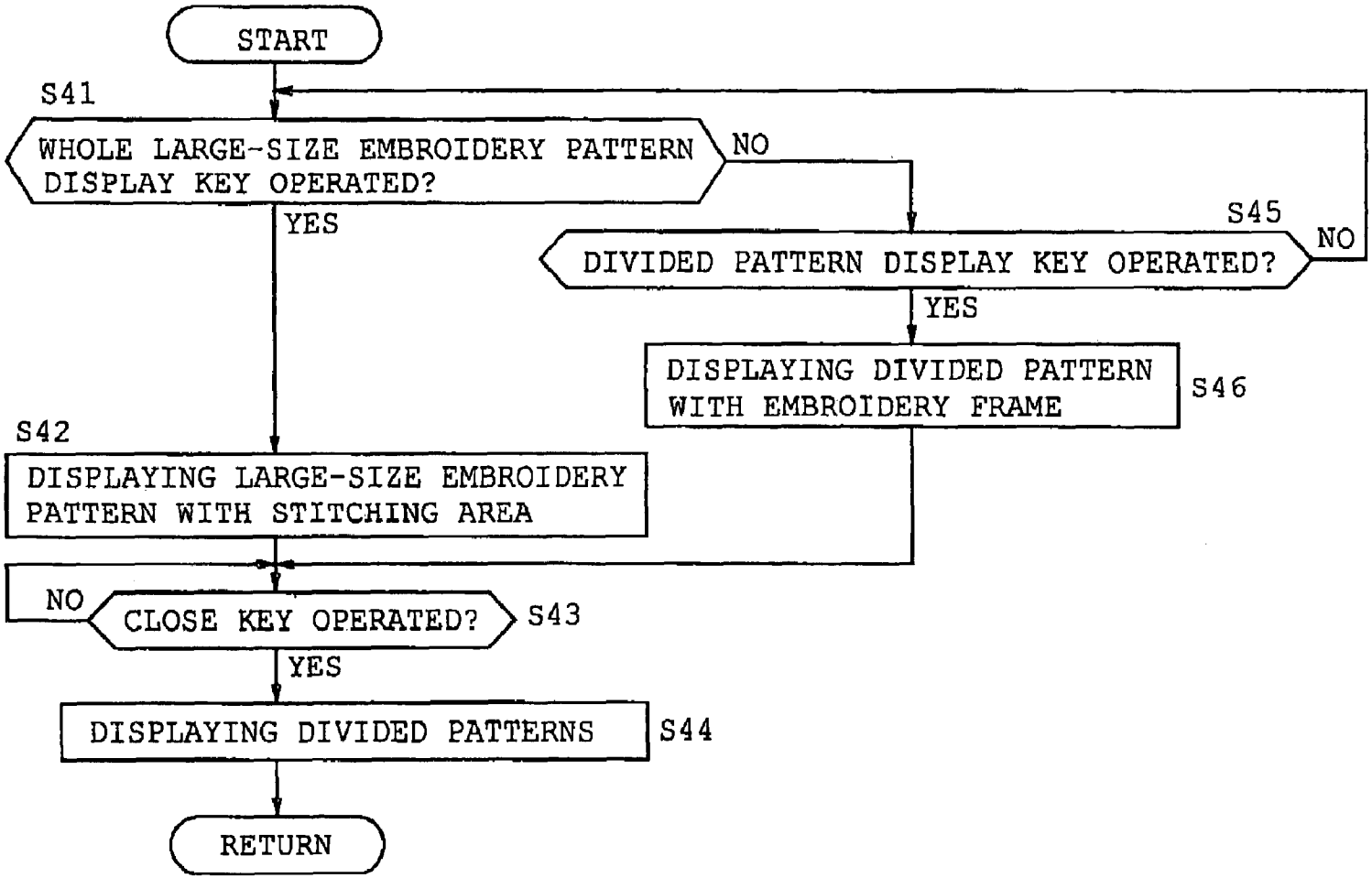
FIG. 8 is a flow chart showing processing steps in the display pattern changing process control.

The flow chart in FIG. 8 shows the detailed steps of the divided pattern stitching order determination process. That is, in this process, it is determined whether the large-size embroidery pattern whole display key (WHOLE key) 9*u* is operated (S41) first, and then, it is determined whether the divided pattern display key (DIVIDE key) 9*v* is operated (S45). When the WHOLE key 9*u* is operated (S41: Yes), the large-size embroidery pattern 35 accompanying a stitching area of the divided pattern, which is subjected from here to the embroidery stitching is displayed (S42) on the large-size embroidery pattern display screen.

Figure 14:
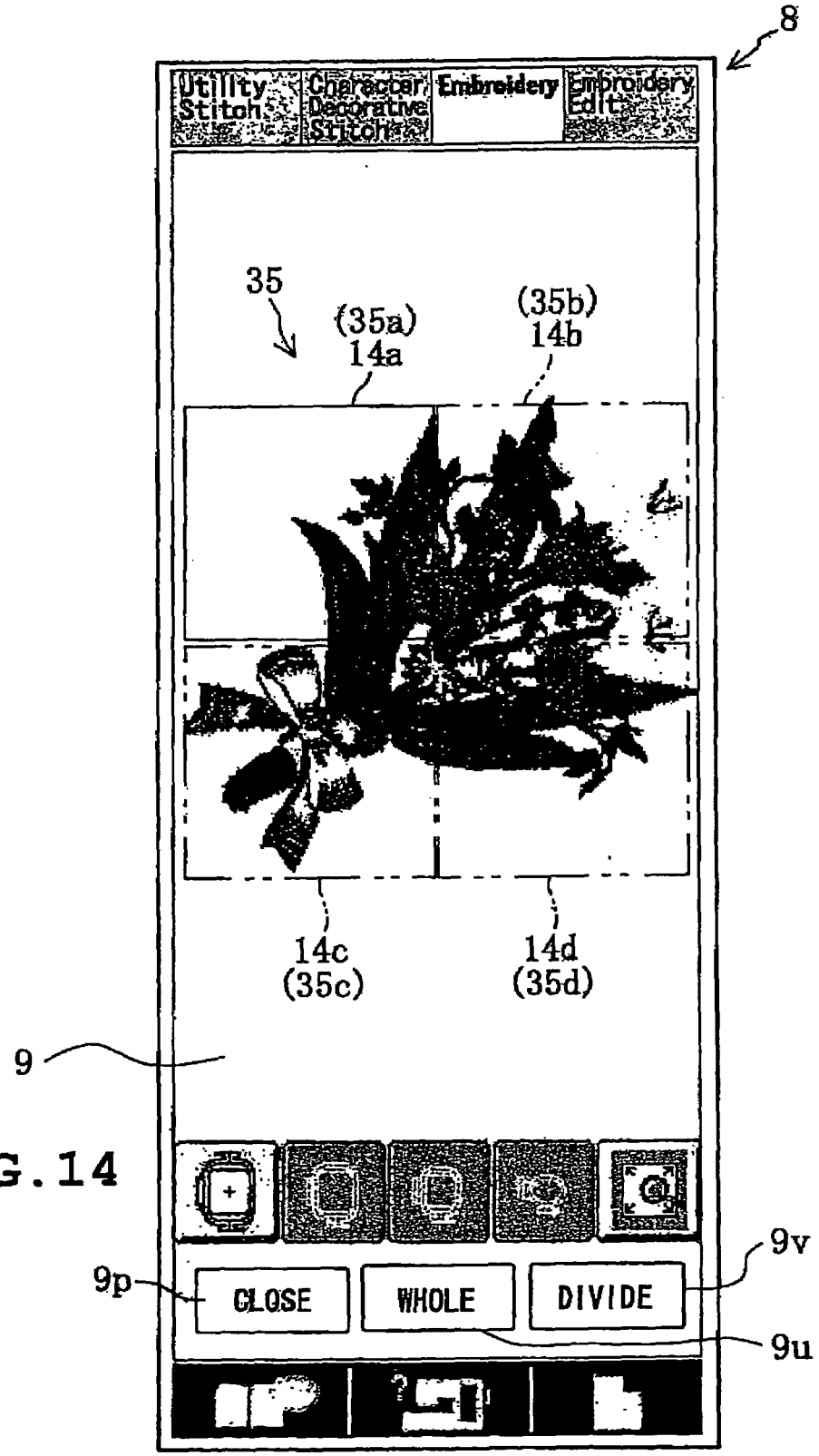
FIG. 14 shows a display example of a display screen of a large-size embroidery pattern including a stitching area.

FIG. 14 shows an example of a whole display screen of the large-size embroidery pattern 35. Here, the rectangular-shaped stitching area 14*a* of a divided pattern to be subjected from here to the embroidery stitching (for example, first divided pattern 35*a*) is displayed along with, for example, the whole large-size embroidery pattern 35 of [bouquet 1]. Based on the coordinates (X0, Y1), (X0, Y2), (X1, Y2) and (X1, Y1) of the 4 vertices of the stitching area 14*a* of the divided pattern 1, displayed area data including 4 segments connecting these four points are generated and the displayed area data is displayed being combined with the pattern display data of the large-size embroidery pattern 35.

Figure 15:
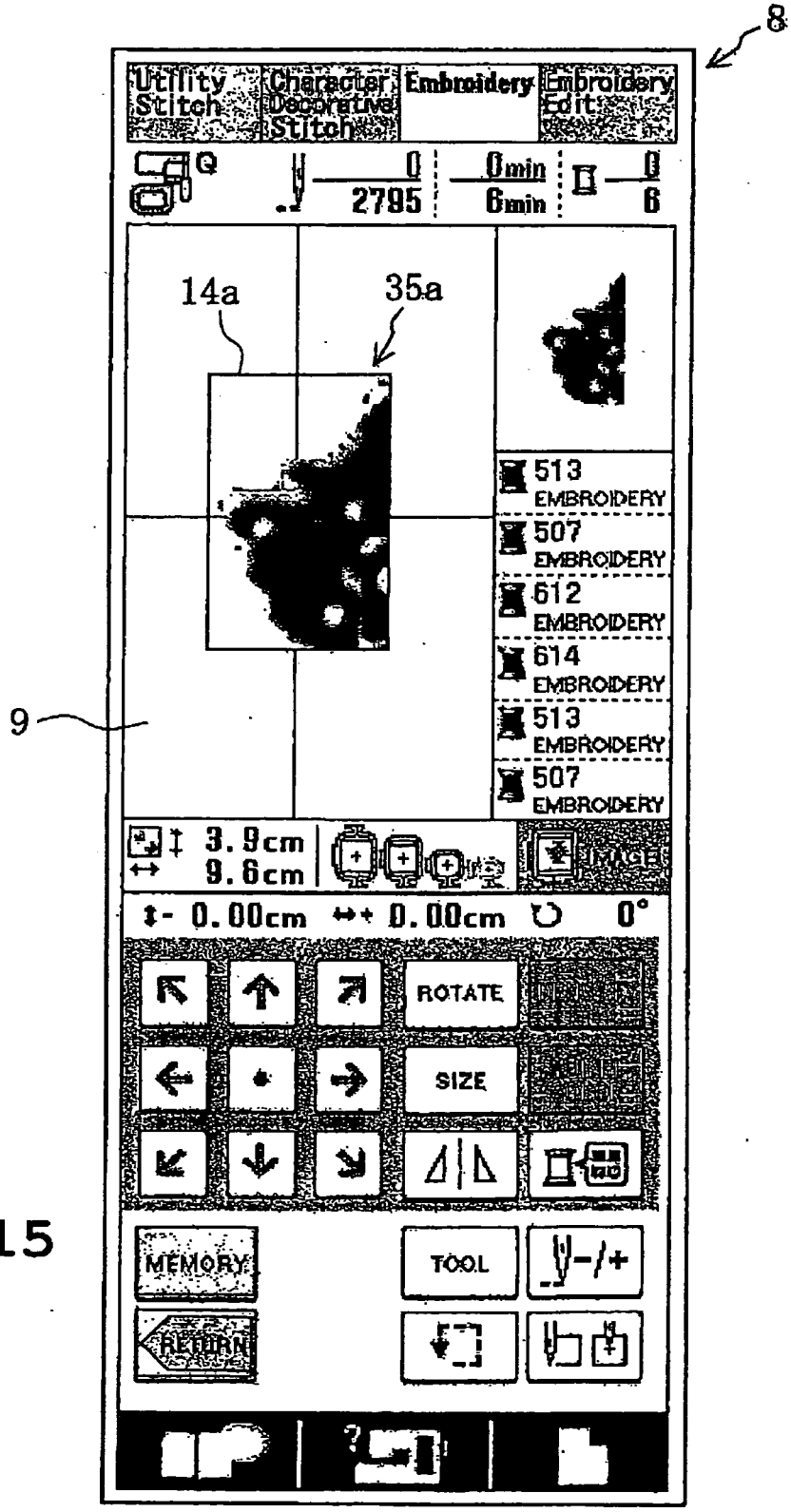
FIG. 15 shows a display example of a divided pattern display screen.

After that, when the close key 9*p* is operated (S43: Yes), the divided pattern display screen is displayed on the display 8 (S44). For example, when the first divided pattern 35*a* is subjected next to the embroidery stitching, the divided pattern display screen is displayed as shown in FIG. 15. In the divided pattern display screen, the first divided pattern 35*a* is displayed along with a frame 14*a* indicating the stitching area.

On the other hand, when the divided pattern display key (DIVIDE key) 9*v* is operated (S45: Yes), the divided pattern with the embroidery frame is displayed in the display 8 (S46). FIG. 16 shows an example of the divided pattern display screen with the embroidery frame. On the display 8, an image 14 of the embroidery frame and an embroidery area 14A therein and the divided pattern 35*a* to be stitched are displayed being combined with each other in the embroidery area 14A.

After that, the process proceeds to step S43, and when the termination key (close key) 9*p* is operated (S43: Yes), the divided pattern display screen is displayed on the display 8 (S44). When the divided pattern display screen is displayed, this control is terminated, and the process returns to the embroidery pattern stitching control (flow chart in FIG. 5).

Referring to the flow chart in FIG. 5 again, when the user operates the ON/OFF switch 7 to start the embroidery stitching of the divided pattern (S18: Yes), while displaying the divided pattern display screen, the embroidery stitching of the divided pattern is carried out (S16).

Figure 9:
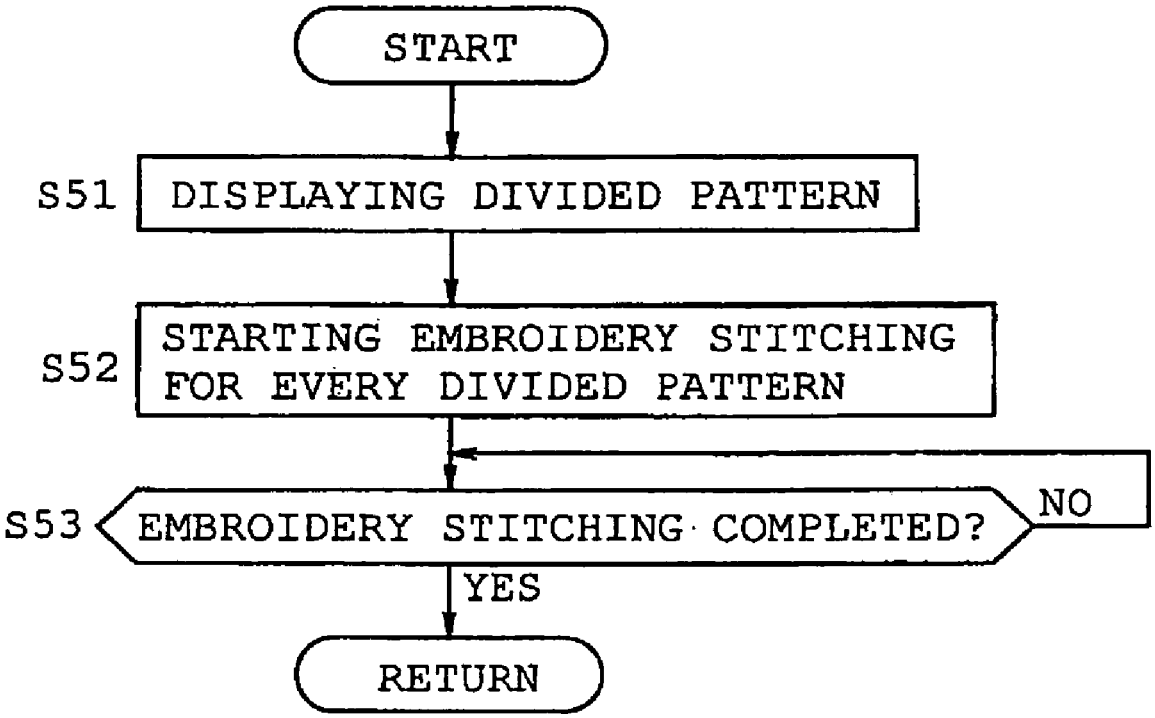
FIG. 9 is a flow chart showing processing steps in the stitching process control of a divided pattern.

The flow chart in FIG. 9 shows the detailed steps of the stitching operation of the divided pattern. That is, first, the divided pattern display screen with respect to the divided pattern to be subjected to the current embroidery stitching is displayed (S51) on the display 8. For example, when the first divided pattern 35*a* is subjected to the embroidery stitching, the divided pattern display screen including the first divided pattern 35*a* is displayed on the display 8 as shown in FIG. 15.

In a state where the divided pattern display screen is displayed, the embroidery stitching of the current divided pattern is started (S52). When the embroidery stitching of the divided pattern has been terminated (S53: Yes), this control is terminated, and the process returns to the embroidery pattern stitching control in FIG. 5. In the embroidery pattern stitching control, when the stitching of all the divided patterns has not yet terminated (S17: No), the steps after S14 are repeatedly carried out.

As the embroidery stitching of the divided patterns proceeds in order as described above, in the display pattern changing process, as indicated by a chain double-dashed line, in the large-size embroidery pattern display screen with the stitching area in FIG. 14, when embroidery stitching of the second divided pattern 35*b* is carried out, the rectangular-shaped stitching area 14*b* is displayed. When the embroidery stitching of the third divided pattern 35*c* is carried out, the rectangular-shaped stitching area 14*c* is displayed; and when the embroidery stitching of the fourth divided pattern 35*d* is carried out, the rectangular-shaped stitching area 14*d* is displayed. When the stitching of all the divided patterns has been completed (S17: Yes), this control terminates.

As described above, according to the embodiments of the present invention, the following effects can be obtained. That is, the pattern display data memory 18*b* in the ROM 18 is adapted so as to store the large-size embroidery pattern display data (monochrome bitmap data) for displaying the large-size embroidery pattern in a real image close to an embroidered state. Accordingly, when the large-size embroidery pattern is displayed, the large-size embroidery pattern can be displayed in detail as if the display data were created from the embroidery stitching data.

Accordingly, a precise pattern of the large-size embroidery pattern can be displayed. Further, the pattern display data of the large-size embroidery pattern in a state close to an embroidered state is, not created from the embroidery stitching data, but just read out from the pattern display data memory 18*b*. Therefore, the display processing of the large-size embroidery pattern can be carried out swiftly without causing the controller 15 to forcefully control the display data creation, and the display function of the large-size embroidery pattern can be increased.

Further, when any one of the large-size embroidery patterns 35 is selected, the pattern display data of the selected large-size embroidery pattern 35 is read out from the pattern display data memory 18*b* and displayed on the display. Therefore, every time when the large-size embroidery pattern 35 is selected, the large-size embroidery pattern 35 can be automatically displayed reliably in a state close to an embroidered state. As a result, the displaying operation of the large-size embroidery pattern 35 by the user can be eliminated. And further, the recognition of the large-size embroidery pattern 35 can be increased.

Furthermore, when each of the a plurality of divided patterns 35*a* to 35*d* constituting the large-size embroidery pattern 35 are subject to the embroidery stitching, the pattern display data of the large-size embroidery pattern 35 read out from the pattern display data memory 18*b* and the displayed area data of the stitching area of the divided patterns 35*a* to 35*d* to be stitched are displayed on the display 8 being combined with each other. Accordingly, the stitching operator can check the stitching position of the divided patterns 35*a* to 35*d* to be stitched next while observing the detailed large-size embroidery pattern 35 to be subjected to the embroidery stitching. Accordingly, miss setting of cloth on the embroidery frame 14 can be reliably prevented.

Next, other embodiments in which the above embodiment is partially changed, will be described below.

Figure 17:
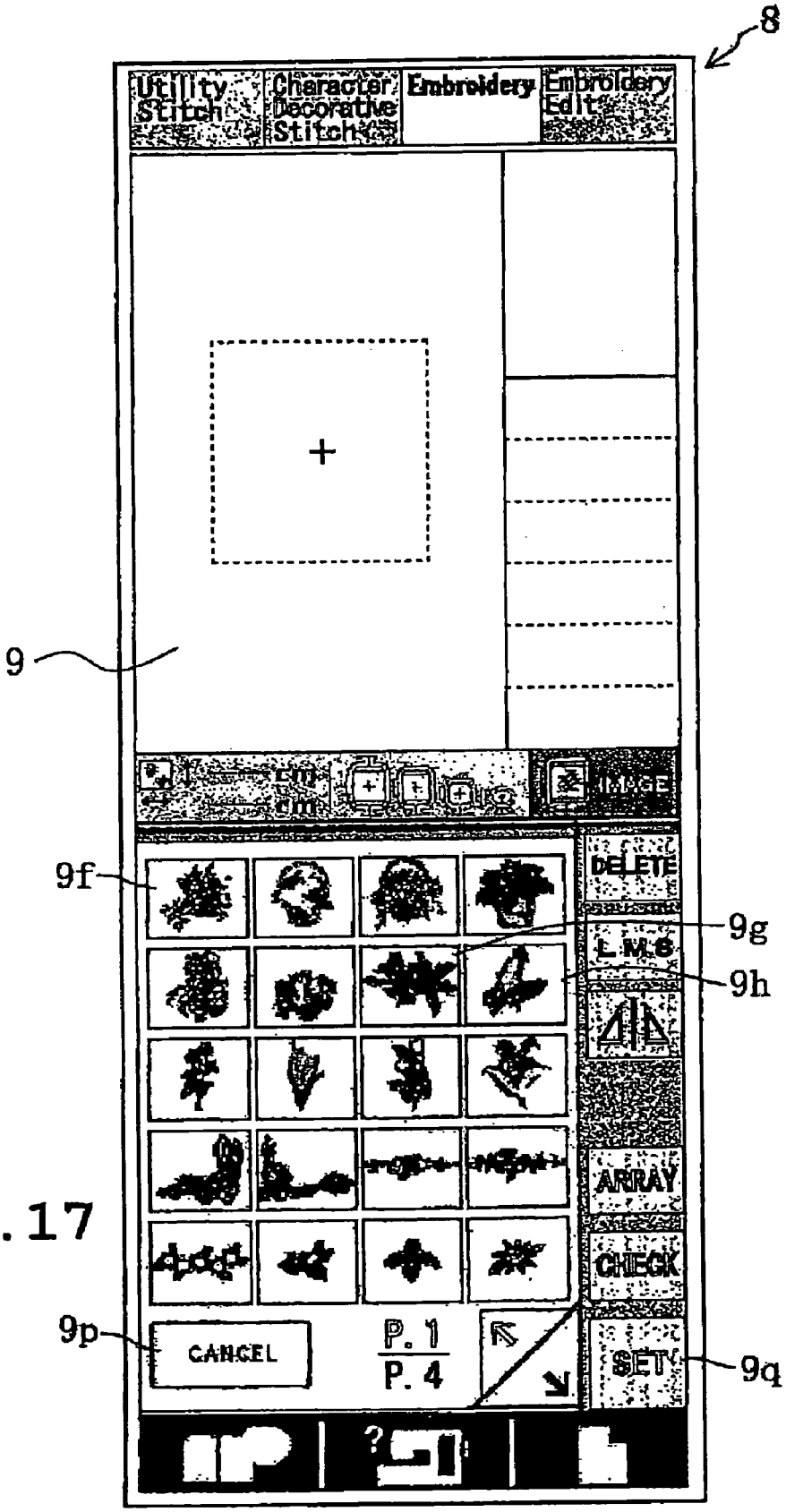
FIG. 17 is a view equivalent to FIG. 11 showing another embodiment of the present invention.

1) In place of the display of the embroidery pattern selection screen in FIG. 11, the large-size embroidery pattern 9*f* may be employed as the display of the embroidery pattern selection screen shown in FIG. 17 so as to be displayed in the same size as that of the ordinary pattern select keys 9*g* and 9*h* for selecting an ordinary embroidery pattern, which can be completed by one embroidery stitching operation.

2) When the divided pattern stitching order check screen shown in FIG. 13 is displayed, in the above-described embodiment, the following method is employed; i.e., specially divided pattern display data for four divided patterns 35*a* to 35*d* constituting large-size embroidery pattern [bouquet 1] 35 is stored along with the pattern display data of the large-size embroidery pattern. However, the divided pattern display data may be created by extracting sectional display data of a divided pattern area prescribed with the display size of each divided pattern in the pattern display data of the large-size embroidery pattern 35.

In this case, since the divided pattern display data for the divided patterns do not have to be stored separately, a smaller memory capacity of the display data memory 19*b* is more possible. Accordingly, the pattern display data of the large-size embroidery pattern can be used effectively. It is a matter of course that each of the divided patterns can be displayed in a real finished state close to an embroidered state.

Figure 18:
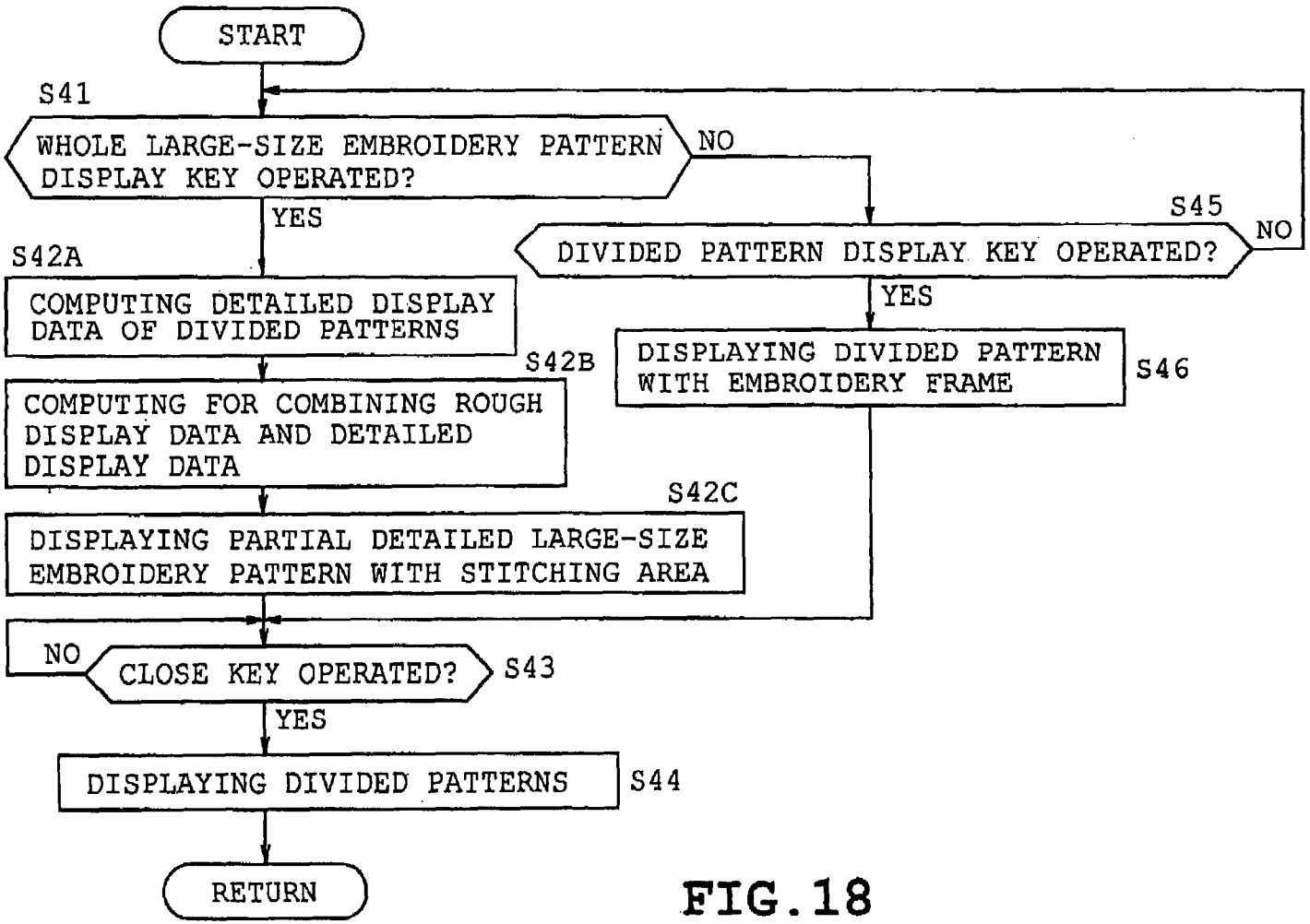
FIG. 18 is a diagram equivalent to FIG. 8 showing still another embodiment.

3) The above-described display pattern changing process control may be partially changed as shown in FIG. 18. While the large-size embroidery pattern is displayed in a rough image, only the divided pattern selected as the object to be stitched may be displayed in detail in a real image.

That is, in the display data memory of the ROM 18, rough display data for causing the display 8 to display the large-size embroidery pattern in a rough image may be stored. The rough display data is constituted of monochrome bit map data in which the configuration of the large-size embroidery pattern is displayed being simplified (seam is not displayed). When the large-size embroidery pattern display key 9*u* is operated (S41: Yes), a detailed display data computing routine is carried out (S42A). In the detailed display data computing routine, based on the embroidery stitching data of the divided patterns stored in the embroidery stitching data 18*a*, detailed display data for displaying divided patterns selected as the object to be stitched in a state close to an embroidered state; i.e., by color display based on a string color code, the seams being represented as the detailed pattern on the display 8, are computed.

Then a display data combining routine is carried out (S42B). In this display data combining routine, in place of the rough display data stored in the display data memory of the ROM 18, display data of the partially detailed large-size embroidery pattern written with the detailed display data of the divided patterns computed by the step S42A is computed. And on the display 8, a partially detailed large-size embroidery pattern display routine in which the combined partial large-size embroidery pattern 35A is displayed along with the stitching area is carried out (S42C).

Figure 19:
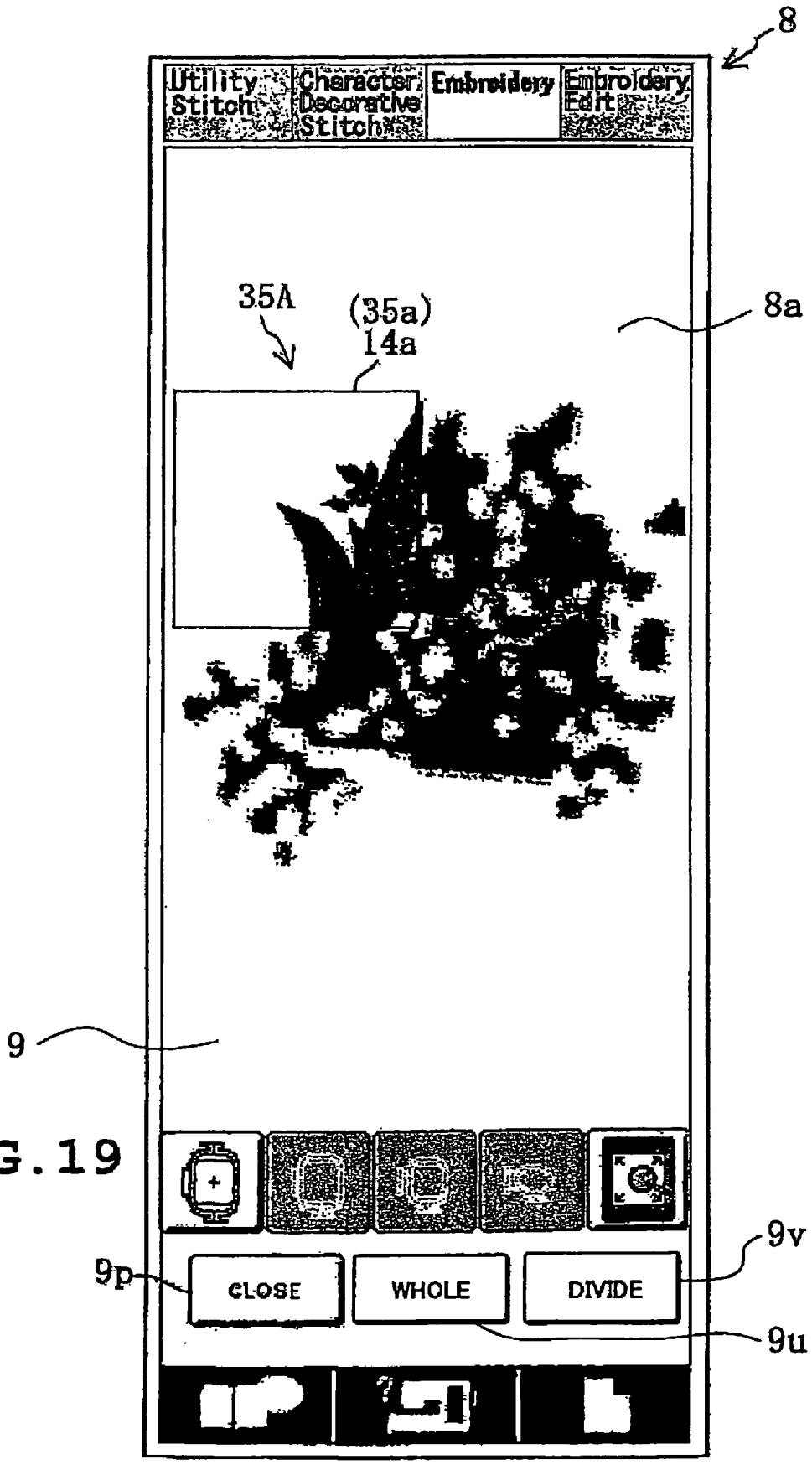
FIG. 19 is a view equivalent to FIG. 14.

Giving a particular example, when the first divided pattern 35*a* is subjected to the stitching as shown in FIG. 19, in addition to the large-size embroidery pattern 35A of a rough image of the [bouquet 1], only the rectangular-shaped stitching area 14*a* of the first divided pattern 35*a* is displayed in a real image close to an embroidered state.

In this case, although the large-size embroidery pattern is displayed in a rough image, in the case when the divided patterns are subjected to the stitching in order, the divided pattern selected as the object to be stitched is displayed as a partially detailed large-size embroidery pattern having a real finished stitching pattern. Accordingly, a highly precise pattern of the large-size embroidery pattern can be realized.

Further, every time when a divided pattern as the object to be stitched is selected, only the detailed display data with respect to the divided pattern is computed. Accordingly, the period of computing time can be reduced resulting in swift display. Furthermore, since the data amount of the detailed display data can be reduced, a smaller memory capacity is more possible.

4) The pattern display data of the large-size embroidery pattern may be color display data including color information.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A sewing machine for embroidery stitching provided with an embroidery frame driving mechanism for driving an embroidery frame based on embroidery stitching data, and in the case of a large-size embroidery pattern larger than an embroidery area of the embroidery frame, capable of dividing the pattern into a plurality of divided patterns and to perform the embroidery stitching, comprising:

an embroidery stitching data storage unit that stores embroidery stitching data of the plurality of divided patterns with respect to a plurality of large-size embroidery patterns;

a display adapted so as to display the embroidery patterns;

a pattern display data storage unit that stores a plurality of pattern display data for displaying each of the plurality of large-size embroidery patterns on the display in a real image close to an embroidered state; and a display control device that reads out pattern display data with respect to an appointed large-size embroidery pattern from the pattern display data storage unit and controls to display an image on the display, the display control device being adapted so that, when each of the plurality of divided patterns constituting the large-size embroidery pattern is subjected to the embroidery stitching, the display control device causes the display to display the pattern display data of the large-size embroidery pattern read out from the pattern display data storage unit and displayed area data indicating the stitching area occupied by each of the divided patterns in the large-size embroidery pattern in a state being combined with each other.

2. The sewing machine according to claim 1, wherein the display control device is adapted so that, when any one of the large-size embroidery patterns is selected by a user, the display control device reads out the pattern display data of the large-size embroidery pattern and causes the display to display the embroidery pattern automatically.

3. The sewing machine according to claim 1, further comprising a divided pattern display data producing unit that produces divided pattern display data for causing the display to display each of the a plurality of divided patterns constituting the large-size embroidery pattern from the pattern display data of the large-size embroidery pattern.

4. The sewing machine according to claim 1, wherein the display control device is adapted so that, every time when the embroidery stitching of one divided pattern is completed, the display control device switches the display of the stitching area automatically in accordance with the stitching order of the divided patterns based on the displayed area data.

5. A sewing machine for embroidery stitching provided with a embroidery frame driving mechanism for driving a embroidery frame based on embroidery stitching data, and in the case of a large-size embroidery pattern larger than an embroidery area of the embroidery frame, capable of dividing the pattern into a plurality of divided patterns and to perform the embroidery stitching, comprising:

an embroidery stitching data storage unit that stores embroidery stitching data of the plurality of divided patterns with respect to a plurality of large-size embroidery patterns;

a display adapted so as to display the embroidery patterns;

a rough display data storage unit that stores rough display data for displaying the large-size embroidery pattern on the display in a rough image;

a detailed display data computing unit that computes detailed display data for displaying the divided pattern on the display in a real image close to an embroidered state based on the embroidery stitching data of the divided pattern stored in the embroidery stitching data storage unit;

a display control device unit that combines rough display data stored in the rough display data storage unit and detailed display data of the divided pattern computed by the detailed display data computing unit, and controls the display to display a partially detailed large-size embroidery pattern.

6. The sewing machine according to claim 5, wherein the detailed display data computing unit computes detailed display data of a divided pattern selected as an object to be stitched in the large-size embroidery pattern, the display control device is adapted so as, in place of the rough display data of the divided pattern selected as the object to be stitched, to compute detailed display data with respect to the divided pattern computed by the detailed display data computing unit to be combined and written in, and to cause the display to display the partially detailed large-size embroidery pattern.

7. The sewing machine according to claim 5, wherein the display control device is adapted to cause the display to display the displayed area data indicating the stitching area occupied by the divided pattern displayed based on the detailed display data in a state being combined with the partially detailed large-size embroidery pattern.

8. A computer readable memory medium which is accessed by a computer for controlling the display to execute a display control, which is incorporated into a sewing machine equipped with an embroidery frame driving mechanism for driving an embroidery frame based on embroidery stitching data stored in an embroidery stitching data storage unit and a display; in the case of large-size embroidery pattern larger than the embroidery area of the embroidery frame, capable of dividing the pattern into a plurality of divided patterns to perform the embroidery stitching, the memory medium storing program instructions comprising:

a detailed display data computing routine for computing detailed display data for causing the display to display a divided pattern in a real image close to an embroidered state based on the embroidery stitching data of the divided pattern;

a display data combining routine for reading out rough display data of a large-size embroidery pattern from a rough display data storage unit storing rough display data for causing the display to display the large-size embroidery pattern in a rough image and combining the rough display data and the detailed display data to create display data of partially detailed large-size embroidery pattern; and a partially detailed large-size embroidery pattern display routine for causing the display to display a partially detailed large-size embroidery pattern based on the combined display data.

* * * * *